US005961132A

United States Patent [19]

Post

[11] Patent Number: 5,961,132

[45] **Date of Patent: *Oct. 5, 1999**

[54] IN-LINE SKATE FRAME AND TOOL DEVICE ADAPTED FOR A QUICK-RELEASE IN-LINE SKATE WHEEL AXLE

[76] Inventor: Peter G. Post, 3167 - 7th St., Boulder, Colo. 80304

[ * ] Notice: This patent is subject to a terminal disclaimer.

[21] Appl. No.: 08/834,944

[22] Filed: Apr. 7, 1997

Related U.S. Application Data

[63] Continuation-in-part of application No. 08/778,697, Jan. 3, 1997, Pat. No. 5,882,087.

[51] Int. Cl.[6] ..... B60B 27/00

[52] U.S. Cl. ..... 280/11.22; 280/11.27; 301/5.3; 301/5.7; 301/110.6

[58] Field of Search ..... 280/11.19, 11.27, 280/11.28, 11.22; 301/128, 125, 5.3, 5.7, 110.6

[56] References Cited

U.S. PATENT DOCUMENTS

| | | | |
|---|---|---|---|
| 4,666,168 | 5/1987 | Hamill et al. | 280/11.27 |
| 5,312,120 | 5/1994 | Wiegner | 280/11.27 |
| 5,441,286 | 8/1995 | Pozzobon | 280/11.27 |
| 5,601,299 | 2/1997 | Yun et al. | 301/5.3 |
| 5,823,545 | 10/1998 | Goeckel | 280/11.28 |
| 5,882,087 | 3/1999 | Post | 301/5.3 |

*Primary Examiner*—Richard M. Camby
*Attorney, Agent, or Firm*—Emery L. Tracy

[57] ABSTRACT

A tool for removing a wheel assembly from an in-line skate is provided. The in-line skate has a boot portion and a blade frame having opposing apertures and mounted to the boot portion. The wheel assembly has a wheel axle releasably mounted within the apertures of the blade frame and a wheel rotatably mounted on the wheel axle. The wheel axle has first and second axle ends end movable toward each other and biased away from each other. The tool comprises a flexible substantially U-shaped member having a main body portion and first and second tip ends contactable with the respective axle ends. A gripping mechanism on the main body portion grips the wheel wherein flexure of the main body portion causes the gripping mechanism to grip the wheel and the first and second tip ends to contact respective axle ends causing the first and second axle ends to move toward each other freeing the first and second axle ends from the apertures. A blade frame for an in-line skate is also provided. The blade frame comprises a mounting wall mounted to the boot portion and a pair of parallel side walls perpendicular to the mounting wall. At least one rib extends along each of the side walls. A recessed portion surrounds each of the apertures with the recessed portion sized to receive a fingertip to depress the first and second axle ends toward each other freeing the first and second axle ends from the apertures.

14 Claims, 6 Drawing Sheets

IN-LINE SKATE FRAME AND TOOL DEVICE ADAPTED FOR A QUICK-RELEASE IN-LINE SKATE WHEEL AXLE

CROSS-REFERENCE TO RELATED APPLICATIONS

This application is a continuation-in-part of patent application Ser. No. 08/778,697 filed on Jan. 3, 1997, now U.S. Pat. No. 5,882,087 entitled "Quick Release In-Line Skate Wheel Axle.

BACKGROUND OF THE INVENTION

1. Field of the Invention

This invention relates generally to in-line skate frame and tool devices for an in-line skate and, more particularly, it relates to in-line skate frame and tool devices for an in-line skate which has a quick-release in-line skate wheel axle.

2. Description of the Prior Art

Today, in-line roller skating is a popular activity enjoyed by many recreationists and enthusiasts. Because of the ever increasing popularity, many manufacturers have developed and continue to develop new and improved in-line skates. In the prior art, many references focus on removing the blade from the boot. Evidently, however, prior to the filing of the cross-referenced patent application entitled "Quick Release In-Line Skate Wheel Axle", above, no references providing for quick release of the individual wheels and/or axles of an in-line skate are known.

To date, traditional methods of attaching the skate wheels to the blade frame utilize a bolt axle bolted to the blade frame by conventional methods. Attachment of the bolt axles to the blade frame is generally accomplished by using at least one or more wrenches; one wrench on each side of the of the blade frame. Upon attachment to the blade frame, the bolt heads on the bolt axle are generally positioned outside the blade frame. Positioning the bolt heads outside the blade frame often subjects the bolt heads to extreme wear since the bolt head will frequently contact the skating surface when the in-line skate is angled during tuns, intentionally scraped along by the skater during specific skate maneuvers, etc. In fact, often the bolt heads wear to the point that the bolt axles can not be removed from the blade frame using a conventional wrench. In a few instances, the skate wheels are actually riveted to the blade frame and are essentially not removable from the blade frame by conventional methods.

The Gierveld, U.S. Pat. No. 5,388,846 describes a shoe 12 provided with a sole plate 17 carrying two threaded parts 18, 19 and a roller skate 11 having a frame 13 with wheels 14–16 and front and rear brackets 21, 22 for receiving the threaded parts 18, 19 to attach the frame 13 to the sole plate 17 of the shoe 12. As illustrated in FIG. 13 of the Gierveld patent, a tapped axle extends beyond the outer surface of the frame extension to which the wheel assembly mounts securely thereon. Two bolts 2 are threaded onto the ends of the axles securely attaching the axle to the frame extensions. The wheel assembly includes a tubular spacer 6 between the inner surfaces 8 of the frame extension with the axle running therethrough.

Furthermore, the wheel assembly of the Gierveld patent has two enclosed ball bearing assemblies 5 with the balls retained within either an inner raceway or an outer raceway. The inner raceway 3 rests on the spacer 6 providing free rotation of the ball bearing around the spacer. The outer raceway 5 is either part of the wheel hub 7 or formed in a ring fitted into the wheel hub 7. In the Gierveld patent's assembly, the wheel rotates via the ball bearings and the bolts are securely tightened retaining the spacer and the wheel via the ball bearings to the frame extensions. Also, the bolts are retained in recessed parts of the frame. Additionally, the axle can be threaded into tapped holes in the two opposing frame openings so that no bolt or nut is needed.

While attempting to address the problem of nut and/or bolt wear, the design of the Gierveld patent does not overcome the problem itself. In the Gierveld patent, the design of the axle is basically a bolt with a threaded tip, and the frame hole being tapped with a matching thread to receive the axle tip. The axle tip does not extend through the frame to the outside surface of the frame thereby shielding the axle from exposure to the wear described above. Regardless, however, the bolt head must be recessed to prevent wear to the bolt head. In the Gierveld patent, additional tools are required for tightening and re-tightening the bolts.

In the prior art, other in-line skate wheels are retained to the blade using bushings and other such methods. Also, the prior art further describes systems wherein the in-line skate itself is disconnectable from the boot. See, for example, the Olsen et al, U.S. Pat. No. 5,314,199. Nevertheless, all of the above designs require additional, and sometimes cumbersome, tools to disconnect the wheels from the frame, if the wheels can be disconnected at all!

SUMMARY OF THE INVENTION

The present invention provides a wheel axle where the distal ends of the axle move relative to each other along the longitudinal axis of the axle. The ends are arranged and designed to extend into the opposing apertures in an in-line skate blade frame that straddles the wheel. Spring means bias the ends apart and the axle portion that resides between the frame members is arranged and constructed to accommodate a wheel hub allowing substantially free rotation of the wheel The ends of the axle can be depressed manually to slip the wheel and axle out from between the straddling frame members.

The present invention in another embodiment provides an axle that is formed from two telescoped tubular structures; i.e., one tube sliding within another. The ends of the tubes are arranged to extend through the opposing apertures in a blade frame to secure the wheel assembly to the frame. A spring or other biasing means within the tubes forces or biases the tubes apart. The axle can be provided with raceways for ball bearings or for the placing of a ball bearing assembly that is part of the wheel itself In other embodiments, a bushing or other such rotating structures are provided.

In another embodiment, the biasing of the spring can be implemented with a coiled spring, or with an elastomer that fills (or not) the inside cavity of the axle. Another implementation uses a spring washer or a slit-washer that provides a spring force. The spring washer is placed in the axle and construction of the axle can be accomplished to utilize such washers as spring forces. Yet another type of spring-force can be found from a wish-bone or leaf type of spring configuration designed to fit in an axle. Other mechanisms that provide force that can be used to advantage within the present invention include gas filled bladders or magnetic poles that attract or repel each other.

In another embodiment, a single tube cylinder is provided. Raceways or other artifacts are provided to accommodate ball bearings or bushings and the like as described above that would be needed for the wheel. Spring means are provided within the tube where the spring has end caps that are driven outward to extend through the ends of the tube and into the frame apertures as discussed above for the telescoping axle. The ends of the tube have retaining extensions or structures that mate with flanges on the caps that retain the spring within the tube. The tube has two threaded parts which can be opened to allow the spring to be inserted. The tube parts are then threaded together forming the tube. The two caps extend from the ends of the tube and are of dimensions to retain the axle to the frame in a sturdy strong fashion.

In another embodiment, the spring retaining the wheel in the in-line frame is in tension. In this embodiment, there is a hollow bolt configuration having a spring attached within the cavity to the head of the bolt. The distal end of the spring is connected to a rod that is positioned co-axial with the bolt. The bolt is inserted through the in-line frame and the wheel hub and extends through the opposite frame. The rod is pulled out of the bolt cavity and rotated to be cross-wise to the bolt. The spring is in tension and pulls the rod back. However, since the rod is cross-wise, the rod contacts the outside of the wheel frame thereby retaining the wheel in the in-line frame. Other modifications of this arrangement where the spring is in tension can be made. Such modifications have the spring external to the bolt if the wheel has apertures through which the spring is threaded. The ends that extend beyond the frame are recessed in an embodiment to prevent wear.

In another embodiment, the axle is constructed from two magnets with thin retaining heads. The magnets are inserted from the outside surface of the apertures in the in-line skate frame apertures. One magnet has a north pole at the end being inserted and the other magnet a south pole so that the two poles attract each other holding the magnets and the axle in place. The heads are thin to diminish possible wear. However, another embodiment has a single magnetized axle with no retaining heads. In this case, the ends of the magnet-axle are flush with the outer sides of the frame so no wear will occur. The magnet itself will tend to stay aligned and centered in the frame.

The present invention is also a tool for removing a wheel assembly from an in-line skate. The in-line skate has a boot portion and a blade frame having opposing apertures and mounted to the boot portion. The wheel assembly has a wheel axle releasably mounted within the opposing apertures of the blade frame and a wheel rotatably mounted on the wheel axle. The wheel axle has a first axle end and a second axle end movable toward each other and biased in a direction generally away from each other.

The tool comprises a flexible substantially U-shaped member having a main body portion, a first tip end and a second tip end. The first tip end is contactable with the first axle end and the second tip end is contactable with the second axle end. Gripping means are formed on the main body portion for gripping the wheel such that the main body portion causes the gripping means to grip the wheel and the first tip end to contact the first axle end and the second tip end to contact the second axle end causing the first axle end to move in a direction generally toward the second axle end and the second axle end to move in a direction generally toward the first axle end freeing the first and second axle ends from the opposing apertures for removing the wheel assembly from the blade frame.

The present invention is further a blade frame for an in-line skate. The in-line skate has a boot portion with the blade frame being mounted to the boot portion. The blade frame has apertures formed therein and carrying at least one wheel assembly mounted within the apertures and having a wheel axle releasably mounted to the blade frame and a wheel rotatably mounted on the wheel axle. The wheel axle has a first axle end and a second axle end movable toward each other and biased in a direction generally away from each other.

The blade frame comprises a mounting wall mounted to the boot portion and a pair of substantially approximately parallel side walls with the side walls approximately perpendicular to the mounting wall. A recessed portion substantially surrounds each of the apertures in the blade frame with the recessed portion sufficiently sized to receive a fingertip or the like to depress the first and second axle ends of the wheel axle toward each other thereby freeing the first and second axle ends from the apertures for removing the wheel assembly from the blade frame. Preferably, the blade frame has at least one rib extending at least partially along the length of the side wall of the blade frame.

The blade frame also comprises, in another embodiment, a wheel spacer which is positioned on the inside of the opposing apertures of the blade frame. The wheel spacer surrounds each aperture on the blade frame and is substantially circular, though other shapes are within the scope of the present invention. The function of the wheel spacer is to impinge on the outside of the inner race of each ball bearing that is used in the in-line skate wheel so that the wheel may spin freely between the two inner sides of the blade frame.

In another embodiment, the wheel spacer also comprises an axle guide channel. The axle guide channel runs substantially from the bottom of the blade frame to the bottom of the axle aperture in the blade frame. The depth of the axle guide channel is determined partly by the thickness of the side wall of the frame and partly by the thickness of the wheel spacer. The axle guide channel is shaped to most appropriately accept the outside contour of the axle tip of the quick-release axle. In one preferred embodiment, the shape is semi-circular though other contours are within the scope of the present invention. The depth of the axle guide channel is sufficient to promote ease of introduction and removal of an in-line skate wheel incorporating the quick-release axle but not so great as to allow the axle to accidentally slip out of the axle aperture.

In yet another embodiment, the present invention comprises an axle for in-line skates. The axle defines a longitudinal axis. The in-line skates have a frame for carrying at least one wheel arranged between frame extensions with the frame extensions having opposing apertures for retaining the axle therein The axle comprises a first axle member having a first open end and a first axle shaft end retained in one of the opposing apertures and a second axle member having a second open end and a second axle shaft end retained in the other opposing aperture in the frame. The second open end of the second axle member receives the first open end of the first axle member. An interlocking mechanism is positioned about each of the first open end and the second open end for releasably interlocking the first open end of the first axle member within the second open end of the second axle member whereby the first and second axle shaft ends are moveable along the longitudinal axis of the axle to the extent of the of the interlocking mechanism. A spring mechanism biases the first and second axle shaft ends toward and retaining the first and second axle shaft ends within the opposing apertures.

In a preferred embodiment, the first and second axle members are constructed from plastic. Furthermore, the interlocking mechanism comprises an outward extending flange member secured to the first axle member and an inward extending flange member secured to the second axle member, the flange members interlocking with each other to releasably secure the first and second axle members together.

Preferably, the spring mechanism comprises a coil spring. Also, the first open end of the first axle member and the second open end of the second axle member preferably have a substantially circular cross-sectional configuration while the first axle shaft end and the second axle shaft end are substantially cylindrical. In addition, the invention of the present invention preferably comprises a spacer mounted about the first and second axle shafts between each frame extension and the first and second open ends of the first and second axle members.

DETAILED DESCRIPTION OF THE PREFERRED EMBODIMENTS

Figure 1:
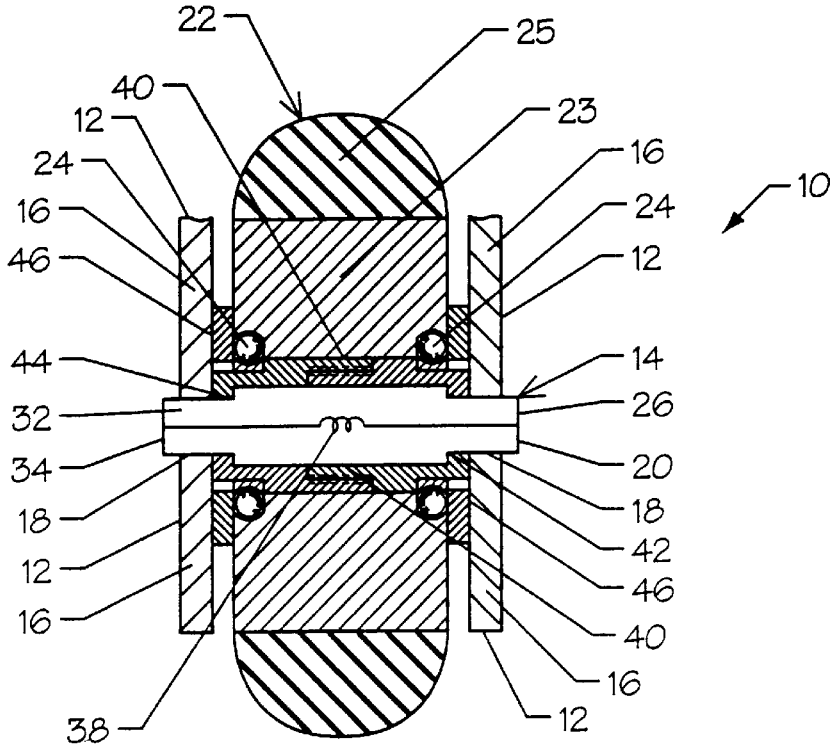
FIG. 1 is a sectional view illustrating an embodiment of the present invention.

As illustrated in FIG. 1, the present invention is a quick-release in-line skate wheel axle, indicated generally at 10, for an in-line skate (not shown). Typically, the in-line skate has a boot portion (not shown), a blade frame 12, and a wheel assembly 14. The blade frame 12 has a pair of side walls 16 and opposing apertures 18 formed in the side walls 16. The blade frame 12 is mounted to the boot portion and the wheel assembly 14 is mounted within the blade frame 12. The wheel assembly 14 includes a wheel axle 20, at least one wheel 22 having a wheel hub 23 and friction material 25 rotatably mounted about the wheel axle 20, and a plurality of ball bearings 24 mounted between the wheel 22 and the wheel axle 20 to provide free rotation of the wheel 22 about the wheel axle 20. While the wheel assembly 14 is being described heretofore and hereafter as rotating about the ball bearings 24, other types of wheel assemblies utilized on in-line skates are within the scope of the present invention.

As illustrated in FIG. 1, in a first embodiment of the quick-release wheel axle 10 of the present invention, the wheel axle 20 comprises a first tubular member 26 having a closed first end 28 and an open second end 30, a second tubular member 32 having a closed first end 34 and an open second end 36, and a spring member 38. The first tubular member 26 extends through the in-line skate blade frame 12 with the open second end 30 of the first tubular member 26 telescoping into the open second end 36 of the second tubular member 32 at an approximate location 40 between the side walls 16 of the blade frame 12. The spring member 38 is attached to the closed first end 28 of the first tubular member 26 and the closed first end 34 of the second tubular member 32 biasing the first tubular member 26 in a direction generally away from the second tubular member 32 into the apertures 18 in the blade frame 12.

Still referring to FIG. 1, the first tubular member 26 has a shoulder 42 and the second tubular member 32 has a shoulder 44 that are designed and constructed to mate with the ball bearings 24 that are either a part of the roller wheel hub itself or separately fixed to the roller wheel hub 23. Spacers 46 can be provided in another preferred embodiment between the side walls 16 and the ball bearings 24. The spacers 46 can be constructed as part of the axle 20 itself or as separate pieces. An advantage of the quick-release wheel axle 10 of the present invention over the prior art in this regard is that the action of the shoulders 42, 44 and the spacers 46 fills any space present due to variations inherent in manufacturing of the blade frame 12 and the wheel 22. The variations typically cause the wheel of the in-line skate to wobble which causes potentially dangerous instability and increased wheel and axle wear.

Still referring to FIG. 1, the outer blade frames of the ball bearings 24 can be part of the wheel hub 23 to which the friction material 25 is attached.

Figure 2:
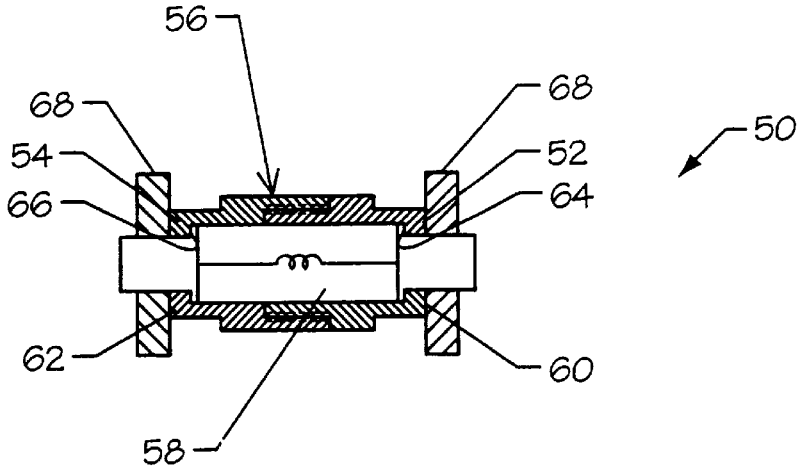
FIG. 2 is an sectional view illustrating another embodiment of the present invention.

In another embodiment of the quick-release skate wheel axle 50 of the present invention, as illustrated in FIG. 2, the wheel axle 50 has a first tubular member 52 and a second tubular member 54 preferably threaded together forming a single tube 56 having an inner substantially cylindrical chamber 58. The single tube 56 has a pair of annular lip portions 60, 62 at each end of the inner chamber 58 wherein the diameter of the inner chamber 58 of the single tube 56 is greater that the diameter of the ends of the single tube 56. The single tube 56 farther has shoulders 64, 66 accommodating the ball bearings as described above. As in the previous embodiment illustrated in FIG. 1, the wheel axle 50 preferably includes spacers 68, 70 allowing the wheel to freely spin within the blade frame 72.

Figure 3:
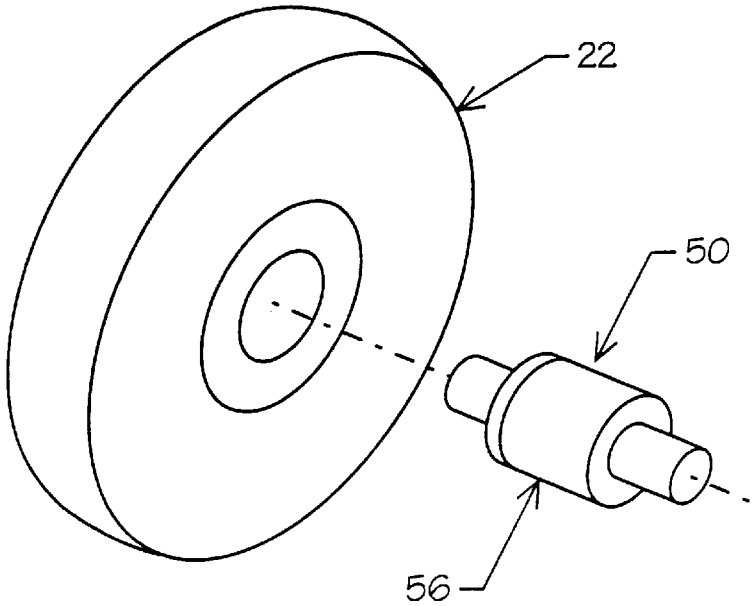
FIG. 3 is a perspective view illustrating the orientation as the axle being inserted into the wheel assembly.
Figure 4:
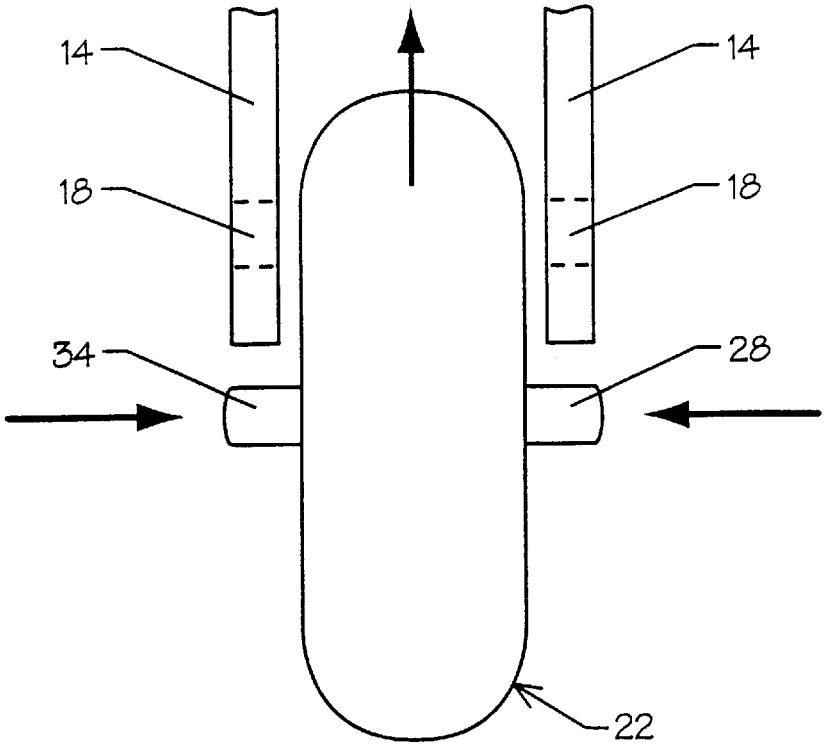
FIG. 4 is a front view illustrating the axle and wheel being inserted within a in-line skate frame.

As illustrated in FIG. 3, to construct the wheel assembly 14 of the present invention, the wheel axle 10 is inserted into the wheel 22. As illustrated in FIG. 4, the wheel assembly 14 is inserted between the side walls 16 of the blade frame 12. The user simply squeezes the closed first ends 28, 34 of the first and second tubular members 26, 32, respectively, toward each other overcoming the bias of the spring member 38. The user then slides the wheel assembly 14 between the blade frame side walls 16 until the closed first ends 28, 34 of the first and second tubular members 26, 32, respectively, are aligned with the opposing apertures 18 of the blade frame 12. The first closed ends 28, 34 of the first and second tubular members 26, 32, respectively, are then released by the user and the bias of the spring member 38 causes the first closed ends 28, 34 to be matingly received by the opposing apertures 18. It should be noted that no tools are required to insert the wheel assembly 14 into the blade frame 12.

Removing the wheel assembly 14 is accomplished by simply reversing the process as described immediately above. The user simply squeezes the closed first ends 28, 34 of the first and second tubular members 26, 32, respectively, overcoming the bias of the spring member 38. The wheel assembly 14 is then manipulated until the closed first ends 28, 34 of the first and second tubular members 26, 32, respectively, are free from the opposing apertures 18. Finally, the wheel assembly 14 is moved clear of the blade frame 12.

Figure 5:
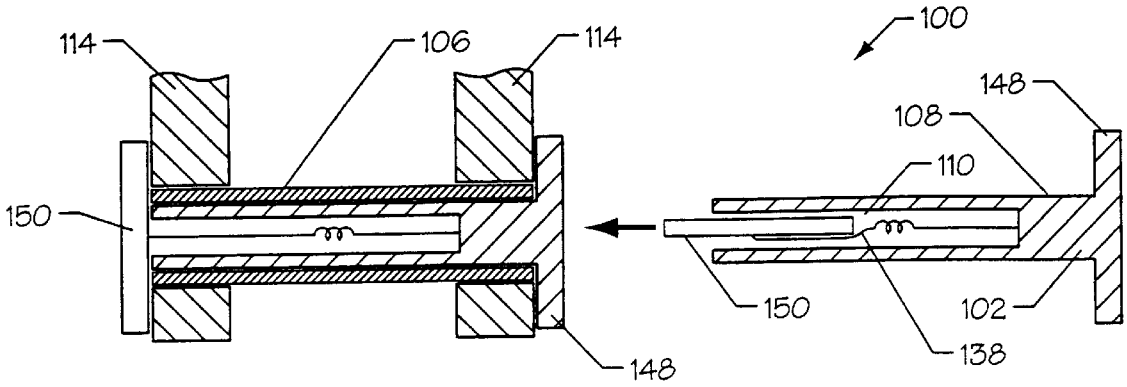
FIG. 5 is a sectional view illustrating yet another embodiment of the present invention having a spring in tension.

In another embodiment of the quick-release axle 100 of the present invention as illustrated in FIG. 5, an internal spring 138 in tension holds the wheel assembly 114 within the blade frame 112. The wheel assembly 114 has an insert 102 illustrated prior to insertion with arrows 104 indicating the direction of insertion. The wheel assembly 114 further preferably has a sleeve 106 mounted within the wheel hub 123 of the wheel 122 and/or the bearings 124 or bushings (not shown) through which the insert 102 can be inserted. A housing 108 having a cavity 110 and a capped-end 148 abuts the outside of the blade frame 114 when inserted. A bar 150 is retained in the cavity 110. When inserted, the bar 150 can be pulled out and rotated ninety degrees to block removal of the insert 102. It should be noted that recesses (not shown) can be formed in the blade frame side walls 116 allowing the bar 150 and the capped end 148 to lie flush with the side walls 116 of the blade frame 114.

Figure 6:
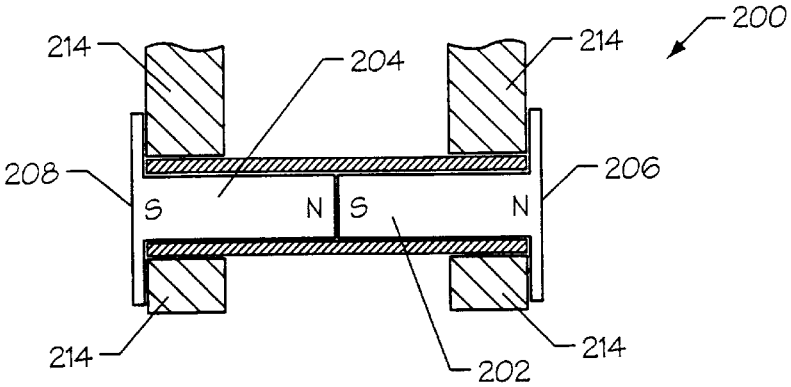
FIG. 6 is a sectional view illustrating still another embodiment of the present invention using magnets.

In yet another embodiment of the quick-release skate wheel axle 200 of the wheel assembly 214 of the present invention as illustrated in FIG. 6, in place of the spring mechanism, a pair of magnets 202, 204 with attracting poles urge the magnets 202, 204 together. Preferably, each magnet 202, 204 has a thin head 202 and 204 that abuts the outer surface of the in-line skate blade frame 214.

In still yet another embodiment of the quick-release skate wheel axle of the wheel assembly of the present invention, a one piece magnet axle having ends flush with the outer surfaces of the blade frame is provided. In this embodiment, the materials comprising the blade frame and the sleeve are also constructed from magnetic material. In this embodiment, the magnet is retained within the sleeve or the sleeve is actually incorporated directly into the magnet.

Figure 7:
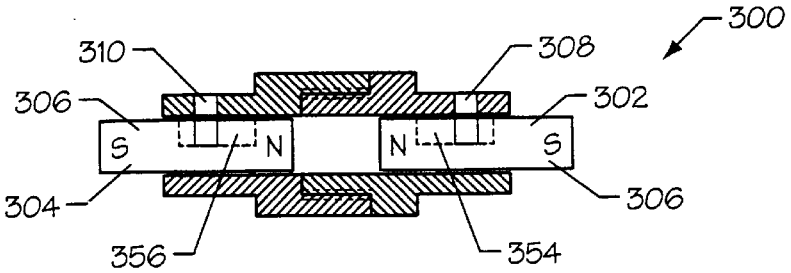
FIG. 7 is a sectional view illustrating pinned end cap with magnets.

In a further embodiment of the quick-release skate wheel axle 300 of the wheel assembly 314 of the present invention as illustrated in FIG. 7, the end caps 302, 304 comprise magnets 306 arranged with opposing poles situated driving the magnets 306 apart. The end caps 302, 304 are so forced into the apertures in the blade frame (not shown in the FIG.). Pins 308,310 are set through the sleeves 350, 352 into the caps 302, 304. A channel 354, 356 is formed in each cap 302, 304 with the pin 308, 310 moving longitudinally allowing each cap 302, 304 to move longitudinally relative to each other sufficient to clear the inner surface of the blade frame spacing at the frame apertures to allow the wheel to be inserted or removed. Alternatively, the channel 354, 356 can be formed in the sleeves 350, 352. The channels 354, 356 allow motion of the end caps 302, 304 to be flush with the outer surface of the blade frame at the apertures. But, as noted above, there is sufficient movement allowing the caps 302, 304 to move towards each other sufficient to clear the inner surface of the blade frame at the apertures.

Figure 11:
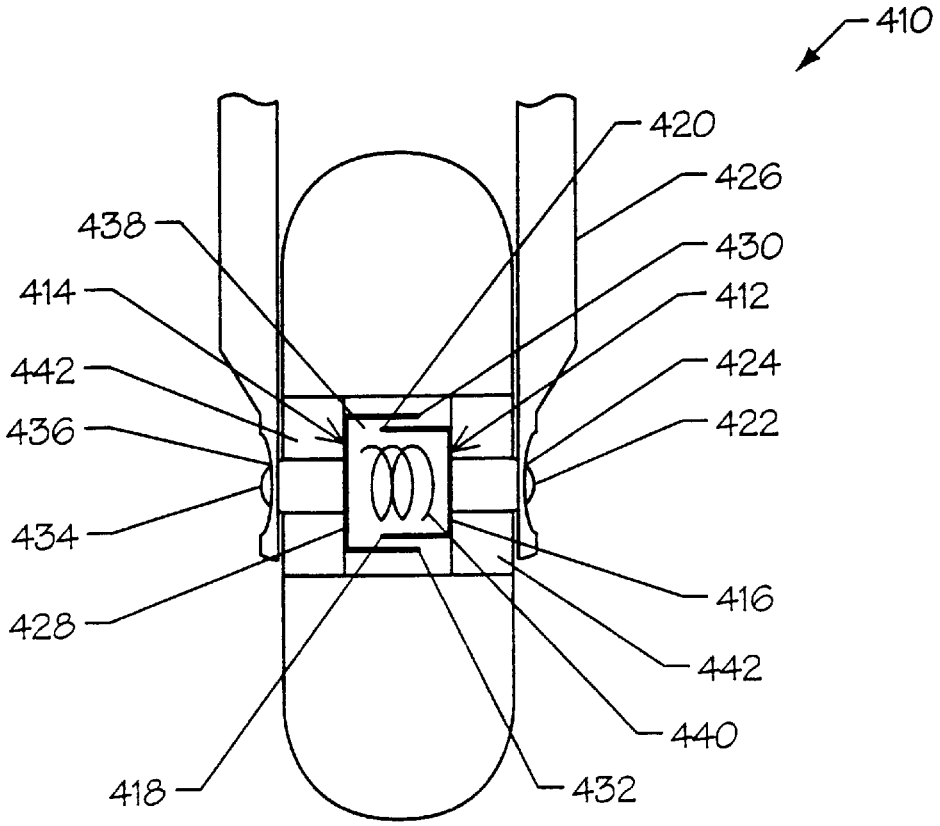
FIG. 11 is a front sectional view of another embodiment of the quick-release axle constructed in accordance with the present invention.

In another embodiment of the present invention, as best illustrated in FIG. 11, the quick-release axle 410 comprises a first axle member 412 and a second axle member 414. The first axle member 412 has a closed first end 416, an open second end 418 having an interlocking flange 420 about the circumference of the second open end 418, and a first axle shaft 422 protruding through one of the apertures 424 in the blade frame 426. The second axle member 414 has a closed first end 428, an open second end 430 having an interlocking flange 432 about the circumference of the second open end 430, and a second axle shaft 434 protruding through an opposing aperture 436 in the blade frame 426. The flange 420 of the first axle member 412 interlocks with the flange 432 of the second axle member 414 creating a chamber 438. The interlocking of the flange 420 and the flange 432 allows the first and second axle members 412, 414 to move along a longitudinal axis of the first and second axle shafts 422, 434 to the extent of the flanges 420, 432 which will inhibit the first and second axle members 412, 414 from being disconnected from one another.

A spring member 440 is captured within the chamber 438 between the first closed ends 416, 428 of the first and second axle members 412, 414, respectively. The spring member 440 acts against the first closed ends 426, 428 biasing the first and second axle members 412, 414 in a direction generally away from each other thereby maintaining the first and second axle shafts 422, 434 in the apertures 424, 436 of the blade frame 426. The axle 410 can be removed from the blade frame 426 by exertion of force on either or both the first and second axle shafts 422, 434 against the bias of the spring member 440 until the first and/or second axle shafts 422, 434 are free from the apertures 424, 436. Furthermore, spacers 442 can be inserted between the first and second closed ends 416, 428 and the blade frame 426 and mounted about the first and second axle shafts 422, 434 to limit the outward movement of the first and second axle members 412, 414.

In the quick-release axle 410, to access the chamber 438 and the spring member 440, the first and second axle members 412, 414 can be easily disconnected by the user by manipulating the first and second axle members 412, 414 to disconnect the flanges 420, 432. To accomplish this, at least the second open ends 418, 430 of the first and second axle members 412, 414, respectively, are preferably constructed of a flexible plastic material. Please note that other materials for construction of the second open ends 418, 430 are within the scope of the present invention.

Other methods include bayonet type mechanisms and, as discussed above, spring washer mechanisms, and preferred embodiments where either spring compression or tension are within the scope of the present invention to be used to retain the axle and wheel to the blade frame while allowing manual quick release of the axle and wheel. Other types of springs and spring material can be, for example, an elastomer or rubber material placed in the axle, a gas or fluid filled bladder, or even magnets with opposing poles might be used in place of a spring in compression to provide a force that drives the poles apart. Like poles would be equivalent to a spring in tension. Other spring forces can be found in particular types of washer designs, e.g. split and beveled.

The preferred embodiments described and illustrated herein describe cylindrical axles. However, although the axles are designed and constructed to accommodate a rotating wheel with ball bearing, bushings and the like, the axle need not be cylindrical throughout its length. Square sectioned or keyed parts of the axle, so as to fit into the blade frame holes on a particular orientation prohibiting axle rotation, can be used in the present invention. In addition, the construction of the axle to allow relative longitudinal movement of the two ends can be accomplished with axles that are not fully cylindrical as are known in the art. For example, a spaced tongue and groove arrangement where the tongue moves to and fro in the groove with a spring force arranged to drive the tongue out of the groove can be used. Another construction uses multiple tongues and grooves, for example.

In the embodiments described and illustrated herein, the closed first ends 28, 34 of the first and second tubular members 36, 32 protrude sufficiently through the side walls 16 of the blade frame 12 to facilitate removal of the in-line skate wheel 22 incorporating the present invention, but not so far that the closed first ends 28, 34 or the axle itself can suffer any appreciable wear. It should be noted that it is within the scope of the present invention to have rounded tips on the closed first ends 28, 34 to further facilitate installation and removal of the in-line skate wheel incorporating the present invention.

In one embodiment of the present invention, the blade frame 12 is machined from a solid piece of aluminum, such as aluminum 7075, for example, and has pressed-fit inserts (not shown) of stainless steel for receiving the wheel axles 10. In another embodiment of the present invention, the side walls 16 rails of the blade frame 12 are molded from a high impact plastic. In this embodiment, the stainless steel axle hole inserts are preferably molded directly into the plastic blade frame 12. Also, in this embodiment, the heel and toe plates are constructed of stainless steel or other metal, such as aluminum 7075, for example, and are also preferably molded directly into the plastic. In still another embodiment, the aluminum or other such material of which the blade frame 12 is constructed is anodized or otherwise micro-coated with Titanium Nitrite (TiN), niflor, or other such known surface hardeners as are known in the art. The micro-coating described serves the same purpose as the stainless steel or other hardened metal inserts by providing a surface substantially as durable and resistant to wear as the quick-release axles themselves. The first and second closed ends 28, 34 are preferably constructed of stainless steel 17-4 pH or equivalent materials. Also, the axle 10 and the blade frame 12 can be constructed from a process known as metal injection molding using such material as magnesium, titanium, etc.

Figure 9:
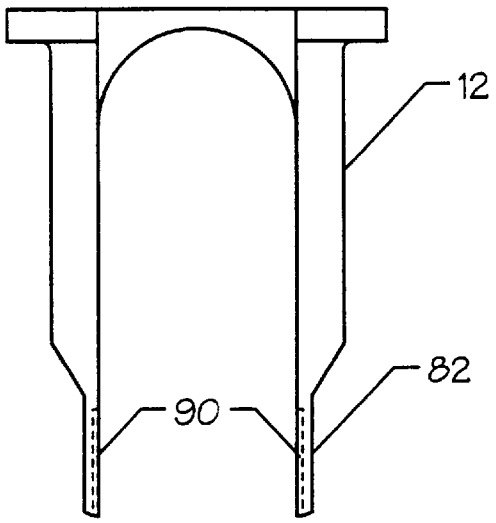
FIG. 9 is a front view of the blade frame constructed in accordance with the present invention.
Figure 10:
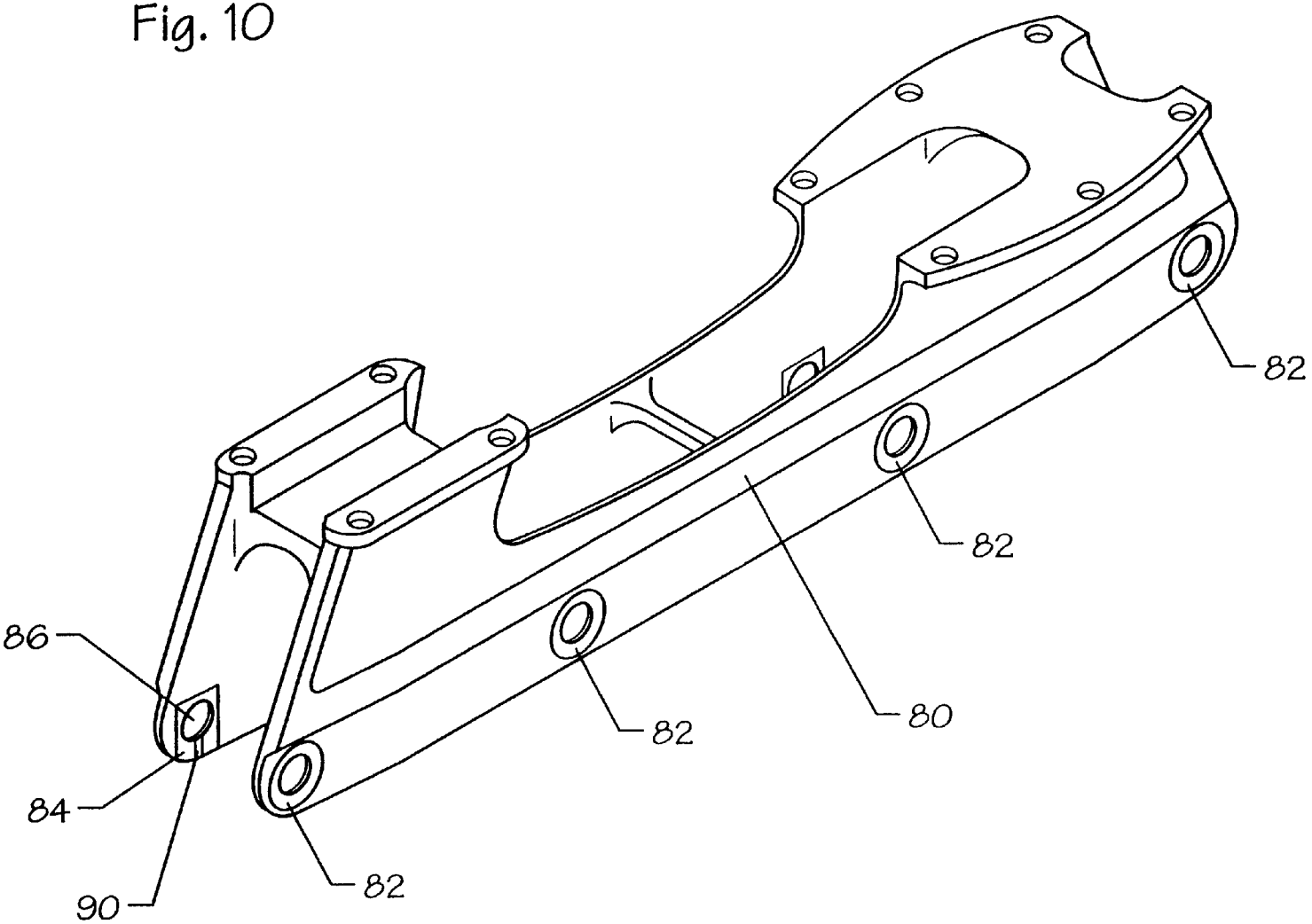
FIG. 10 is a perspective view of the blade frame constructed in accordance with the present invention.

As illustrated in FIGS. 9 and 10, in another embodiment of the present invention, the blade frame 12 has raised nibs 80 extending substantially the length of the blade frame 12 along the outside surface of the side walls 16 of the blade frame 12. The ribs 80, extending substantially the length of the blade frame 12, are preferably positioned above the opposing axle apertures 18 and extend from the horizontal around the anterior and posterior profiles until the ribs 80 reach the heel and toe plates. The ribs 80 greatly increase the lateral strength and rigidity of the blade frame 12. The traditional nut and bolt axle system of the prior art, or any system that uses threaded members to effect a connection between parts serving as an axle, lends great lateral strength to any blade frame in which such a system is utilized. The quick-release wheel axle 10 of the present invention does not rely on the strength of threads, but instead on the outward horizontal force of the spring member captured between two laterally moveable tubular members 26, 32 to effect connection with the blade frame 12. The quick-release wheel axle 10, therefore, does not further strengthen the blade frame 12 in which it is used as does a traditional nut and bolt system or any system that uses threaded members. The ribs 80 on the blade frame 12 create lateral strength and rigidity such that the quick-release axle 10 rides between the frame side walls 16 without the possibility of accidental release due to lateral flexion of the frame side walls 16.

The area horizontally between the axle apertures 18 and vertically between the rib 80 and the bottom of the blade frame 12 can be constructed of a thinner material than the remainder of the blade frame 12 if a second rib also extends horizontally along the bottom of the frame approximately ⅛ inch vertically and approximately the thickness of the thickest part of the blade frame 12 that surrounds the axle apertures 18.

Since the quick-release skate wheel axles 10 of the present invention are not removed or introduced into the blade frame 12 by means of tools, but by fingers, the blade frame 12 of the present invention also incorporates axle aperture depressions 82 facilitating insertion and removal of the wheel assembly 14. The depressions 82 are formed on the outside surface of the side walls 16 of the blade frame 12 surrounding each axle aperture 18. The depressions 82 are dimensioned allowing finger tip access to the exposed ends of the quick-release skate wheel axles 20.

If the blade frame 12 is molded from magnesium, the two ribs are not necessary. Some recess around the axle apertures 18 will still be preferred even if the material is strong enough to allow the frame to be constructed without the depressions 82. The depressions 82 not only allow easy access to the closed first ends 28, 34, but protect the closed first ends 28, 34 from contact by anything larger than a finger tip or thumb tip, for example, the skating surface or curbs or anything similar that could damage the closed first ends 28, 34.

The blade frame 12 preferably has a pressed-in stainless steel or other hardened metal insertion 83 within the axle apertures 18 creating a hardened surface for the wheel axle 20. While the insertion 83 is not necessarily required for operation of the wheel axle 20, the insertion 83 tends to prolong the blade frame 14 life ensuring ease of use of the wheel axle 20 for the life of the blade frame 12. The insertion 83 is designed to fit into the axle apertures 18 of the blade frame 12 such that the closed first ends 28, 34 of the first and second tubular members 26, 32, respectively, are received without any substantial friction and removable from the blade frame 12 with simple finger pressure.

The insertion 83 also preferably incorporates a wheel spacer 84 positioned on the inside of the side wall 16 of the blade frame 12 adjacent the wheels 22, but could easily be adapted to any other bearing size when necessary. The wheel spacer 84 preferably comprises a circular disk of hardened metal or stainless steel, for example, of a thickness sufficient to snugly impinge on the inner race of both of the bearings 24 normally used in in-line skate wheels when the wheel 22 is inserted between the side walls 16 of the blade frame 12. The wheel spacer 84 provides free movement of the wheel 22 between the frame side walls 16 and preferably has an outer diameter dimensioned to contact the inner race of the ball bearings 24 normally used in in-line skate The insertion 83 also incorporates an insertion aperture 86. The insertion aperture 86 is dimensioned to allow the snug fit and easy removal and insertion of the wheel axle 20. The insertion aperture 86 is positioned at approximately the center in an elevation of the insertion 83 and extends horizontally through the insertion 83.

The insertion 83 further incorporates a tip cover 88 consisting of a piece of soft plastic, rubber, or any similar material as is known in the art. The tip cover 88 protects the closed first ends 28, 34 of the first and second tubular members 26, 32 of the wheel axle 20 from unnecessary wear or damage. The tip cover 88 is preferably pressed into place in the blade frame 12 from the inside of the blade frame 12 at the same time as the insertion 83 or can be positioned on the outside side walls 16 of the blade frame 12 or can be part of the original plastic molded frame. The tip cover 88 spans substantially the entire area of the axle apertures 86 in the insertion 83.

The wheel spacer 84 also incorporates an axle guide channel 90 to facilitate removal and insertion of the wheel assembly 14. The axle guide channel 90 has a vertical trough dimensioned horizontally accommodating the closed first ends 28, 34 of the first and second tubular members 26, 32, respectively, as the wheel axle 20 is removed from or inserted into the blade frame 12. The guide channel 90 extends vertically from the bottom of the insertion aperture 86 to the bottom of the insertion 83 which is coterminous, in the preferred embodiment, with the bottom edge of the blade frame 12. The depth of the guide channel 90 is partially determined by the thickness of the wheel spacer 84 of the axle insertion 83 and partially by the thickness of the side wall 16 of the blade frame 12 to which the guide channel 90 is attached.

Whereas the blade frame 12 is preferably constructed of a relatively soft, light material, such as aluminum 7075 or high impact plastic such as is known in the art, the insertions 83 are constructed of a material similar to the material used for the wheel axle 20, such as stainless steel, for example. Stainless steel inhibits wear and burring of the type likely to be encountered in the conditions to which the wheel axle 20 and insertion 83 are subjected. Furthermore, all of the features of the insertion 83 except the extra hardness could me molded or machined into the blade frame 12 itself without actually having the insertion 83.

Figure 8:
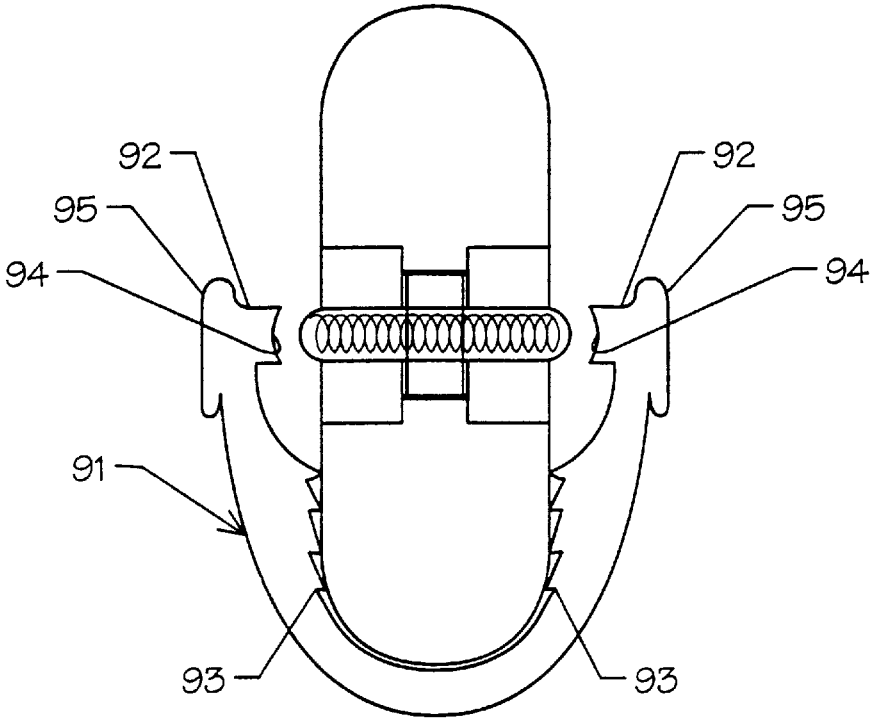
FIG. 8 is a front view of the tool constructed in accordance with the present invention.

Together with the aspects of the blade frame 12 itself mentioned above, i.e. finger tip depressions 82 surrounding the exterior of the axle holes, hardened metal axle hole insertions 83 incorporating wheel spacers 84 and guide channels 90 promote the ease of introduction into and removal of an in-line skate wheel assembly 14 with the quick-release wheel axle 20 from the blade frame 12, the present invention also incorporates a quick-release tool 91, as illustrated in FIG. 8. The quick-release tool 91 aids removal of an in-line skate wheel assembly 14 incorporating the quick-release wheel axle 20 from the blade frame 12 if additional leverage is necessary to remove the wheel assembly 14 from the blade frame 12. The tool 91 is substantially U-shaped with tips 92 at the ends of the "U" positioned to contact and depress the closed ends 28, 34 of the first and second tubular members 26, 32, respectively, of the quick-release axle 20. The tips 92 of the tool 91 should be of such length that the tips 92 can push the axle 20 and the opposite bearing out through the opposite wheel hub, approximately ¼ inch to ½ inch.

In operation, the user positions the tool 91 around the blade frame 12 from underneath it so that the tips 92 of the tool 91 contact with the respective closed first ends 28, 34 of the first and second tubular members 26, 32, respectively, of the quick-release wheel axle 20 of the wheel assembly 14 to be removed. The user squeezes the tool 91 so that the tips 92 of the tool 91 contact the closed first ends 28, 34 depressing the closed first ends 28, 34 toward each other sufficiently to remove the wheel assembly 14 from the blade frame 12.

The quick-release tool 91 also incorporates interior ribs 93 which are designed to contact and hold by friction the sides of the wheel 22 which is to be removed from the blade frame 12 as the tips 92 of the tool 91 are engaged with the closed first ends 28, 34 of the quick-release wheel axle 20. The tool 91 can also be used to remove the quick-release axle 20 from between the bearings 24. The user thereby can depress the quick-release axle 20 and grip the sides of the wheel 22 to be removed at substantially the same time. The tips 92 of the tool 91 are so designed that when the closed first ends 28, 34 have been depressed and the sides of the wheel 22 to be removed are grabbed by the interior ribs 93 of the tool 91, the user can simply pull the wheel assembly 14 away from the blade frame 12 and the tips 92 of the tool 91 will be deflected away from the axle apertures 18 into which they have been depressed since the tool tips 92 have an interior edge 94 which is angled to promote deflection when the tool 91 is pulled in a direction generally downward away from the blade frame 12 while gripping the sides of the wheel 22. The interior ribs 93 of the tool 91 are shaped like flanges pointing downward toward the trough of the U-shape and situated so that when the tool 91 is slid upward over the bottom or exposed portion of the wheel 22 to be removed, they grab the exposed sides of that wheel 22 and allow the user to squeeze the tool tips 92 together so that the closed first ends 28, 34 are pushed inwardly toward each other and the wheel assembly 14 can be removed. Also, finger tip pads 95 are preferably provided on the outside of the tip ends 92 promoting ease of operation and providing a greater surface area for the user's finger tips (not shown).

Preferably, the tool 91 is constructed of a sturdy and pliable plastic, such as Delrin, to withstand many flexions as described above and still remain useful. Certain plastics will be able to withstand the wear suffered by the tips 92 of the tool 91, but covering the tips 92 or constructing the tips 92 entirely of metal material inhibits such wear. In fact, the entire tool can be constructed of metal materials which meet the same requirements as the plastics described above. Aluminum 7075, for example, can flex substantially without taking a set and would perhaps withstand wear as well as or better than any plastic.

As noted above, accidental release of an in-line skate wheel due to loose bolts, for example, could potentially cause serious injury. The quick-release skate wheel axle 10 of the present invention inhibits such release in at least three ways. First, both of the closed first ends 28, 34 of the first and second tubular members 26, 32, respectively, must be depressed simultaneously and completely and, at the same time, together with the user pulling the wheel assembly 14 out and away from the opposing apertures 18 in order to remove the wheel assembly 14.

Second, the compression spring member 38, though not so strong as to make depression of the closed first ends 28, 34 impossible for an average user, is sufficiently strong to resist incidental depression and forces the closed first end 28, 34 of the first and second tubular members 26, 32, respectively, back into place before they can slip from opposing apertures 18 unintentionally. The spring member 38 is designed to provide an adequate force for the wheel axle 20 of the present invention, and, contrasted to known prior art designs, the wheel axle 20 of the present invention never needs tightening.

Third, whereas when there is no pressure on the skate wheel 22, the axle tips 28, 34 can be moved to and fro, when there is pressure, much less than exerted even by a child skater, the friction between the exterior of the axle tip 28, 34 and the interior of the axle aperture 18 in the blade frame 12 substantially inhibits the moving of the axle tips 28, 34. The wheel axle 10 of the present invention, thereby, solves the problem of accidental release better than any known prior art.

The materials needed for all the various parts of the wheel axle 10 of the present invention are similar to those now used in the field. The friction material of the wheel 22, the plastics used for the wheel housing 23, and the steel material involved are those presently being used in this industry. Any lubrications, bushings, ball bearings, and other rotating mechanisms and ancillary requirements are similar to those commonly used in the industry, including but not Limited to titanium, aluminum alloys such as #6061, brass and steel.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A blade frame for an in-line skate, the in-line skate having a boot portion with the blade frame being mounted to the boot portion, the blade frame having apertures formed therein and carrying at least one wheel assembly mounted within the apertures and having a wheel axle releasably mounted to the blade frame and a wheel rotatably mounted on the wheel axle, the wheel axle having a first axle end and a second axle end movable toward each other and biased in a direction generally away from each other, the blade frame comprising:

a mounting wall mounted to the boot portion and a pair of substantially approximately parallel side walls, the side walls approximately perpendicular to the mounting wall; and a recessed portion substantially surrounding each of the apertures in the blade frame, the recessed portion sufficiently sized to receive a fingertip or the like to depress the first and second axle ends of the wheel axle toward each other thereby freeing the first and second axle ends from the apertures for removing the wheel assembly from the blade frame.

2. The blade frame of claim 1 and further comprising a substantially cylindrical insert between the side walls and surrounding the wheel axle.

3. The blade frame of claim 1 and further comprising at least one rib extending at least partially along the length of each of the side walls.

4. The blade frame of claim 3 wherein the rib positioned between the boot portion and the apertures.

5. The blade frame of claim 4 and further comprising wheel spacer adjacent each aperture and machined into the side walls of the blade frame.

6. The blade frame of claim 5 and further comprising a guide channel formed in each of the wheel spacers, the guide channels accommodating the wheel axle during insertion and removal of the wheel axle.

7. The blade frame of claim 1 wherein the axle has an axle tip extending through each of the apertures and further comprising a tip cover covering each of the axle tips.

8. An axle for in-line skates, the axle defines a longitudinal axis, the in-line skates having a frame for carrying at least one wheel arranged between frame extensions, the frame extensions having opposing apertures for retaining the axle therein, the axle comprising:

a first axle member having a first open end and a first axle shaft end retained in one of the opposing apertures;

a second axle member having a second open end and a second axle shaft end retained in the other opposing aperture in the frame, the second open end of the second axle member receiving the first open end of the first axle member;

an interlocking mechanism positioned about each of the first open end and the second open end for releasably interlocking the first open end of the first axle member within the second open end of the second axle member whereby the first and second axle shaft ends are moveable along the longitudinal axis of the axle to the extent of the of the interlocking mechanism; and spring means for biasing the first and second axle shaft ends toward and retaining the first and second axle shaft ends within the opposing apertures.

9. The axle of claim 8 wherein the first and second axle members are constructed from plastic.

10. The axle of claim 8 wherein the interlocking mechanism comprises an outward extending flange member secured to the first axle member and an inward extending flange member secured to the second axle member, the flange members interlocking with each other to releasably secure the first and second axle members together.

11. The axle of claim 8 wherein the spring means comprises a coil spring.

12. The axle of claim 8 wherein the first open end of the first axle member and the second open end of the second axle member have a substantially circular cross-sectional configuration.

13. The axle of claim 8 wherein the first axle shaft end and the second axle shaft end are substantially cylindrical.

14. The axle of claim 8 and further comprising a mounted spacer about the first and second axle shafts between each frame extension and the first and second open ends of the first and second axle members.

* * * * *